US005584907A

United States Patent [19]

Muhammed et al.

[11] Patent Number: 5,584,907

[45] Date of Patent: Dec. 17, 1996

[54] METHOD OF PREPARING MULTICARBIDE POWDERS FOR HARD MATERIALS

[75] Inventors: Mamoun Muhammed, Djursholm; Inger Grenthe, Österskär; Sverker Wahlberg, Hägersten, all of Sweden

[73] Assignee: Sandvik AB, Sandviken, Sweden

[21] Appl. No.: 464,965

[22] Filed: Jun. 5, 1995

[30] Foreign Application Priority Data

Jul. 22, 1994 [SE] Sweden ..... 9402555

[51] Int. Cl.[6] ..... B22F 9/24

[52] U.S. Cl. ..... 75/351; 75/365; 148/237

[58] Field of Search ..... 75/351, 361, 365, 75/369; 148/237

[56] References Cited

U.S. PATENT DOCUMENTS 3,440,035 4/1969 Iwase et al. ..... 75/351

3,488,291 1/1970 Hardy et al. ..... 75/365

5,352,269 10/1994 McCandlish et al. ..... 75/351

*Primary Examiner*—George Wyszomierski

*Attorney, Agent, or Firm*—Burns, Doane, Swecker & Mathis, L.L.P.

[57] ABSTRACT

There is now provided a method for preparing a powder containing W and Co and/or Ni from APT and a soluble salt of Co(Ni) by a chemical reaction in a water suspension at temperatures from room temperature to the boiling point of the solution whereafter the formed powder is filtered off, dried and reduced to a metallic powder. Additional metals from groups IVa, Va or VIa of the periodic table of the elements are added to the suspension as compounds like oxides, hydroxides, soluble or insoluble salts.

5 Claims, No Drawings

METHOD OF PREPARING MULTICARBIDE POWDERS FOR HARD MATERIALS

BACKGROUND OF THE INVENTION

The present invention relates to a method of preparing fine grain multicarbide powders for cemented carbides.

WC-Co-cemented carbides are made by powder metallurgical methods of milling a powder mixture containing powders forming the hard constituents and binder phase, pressing and sintering. The milling operation is an intensive wet milling in mills of different sizes and with the aid of milling bodies which are usually made of cemented carbide. The milling time is of the order of several hours up to days. Milling is believed to be necessary in order to obtain a uniform distribution of the binder phase in the milled mixture. It is further believed that the intensive milling increases the reactivity of the mixture which further promotes the formation of a dense structure.

Because of the long milling time, the milling bodies are worn and contaminate the milled mixture, which has to be compensated for. The milling bodies can also break during milling and remain in the structure of the sintered bodies. Furthermore, even after an extended milling, a non-homogenous rather than an ideal homogeneous mixture may be obtained. In order to ensure an even distribution of the binder phase in the sintered structure, sintering has to be performed at higher temperature than the theoretical.

An alternative way is to start from an intimate mixture of cobalt and tungsten, which mixture subsequently is carburized. The mixture can be obtained through the formation of a composite metal salt by a chemical process step. U.S. Pat. No. 3,440,035 discloses such a method of preparing cemented carbide powder characterized in that an aqueous solution or suspension of ammoniumparatungstate (APT) and nitric or hydrochloric aqueous solution of, e.g., cobalt, are mixed. The mixture is then subjected to a neutralizing reaction with ammonium hydroxide at a temperature of 20° to 80° C. when the pH-value of the mother solution after the reaction is adjusted and between 4.5 to 8. The resultant fine composite precipitate containing tungsten and cobalt in the desired composition controlled by reaction conditions is filtered, dried by heating and then subjected to reduction and carburization to obtain a WC-Co composite powder in which the WC grain size generally is submicron. An improved method characterized by constant control of the solution pH by continuous addition of ammonium hydroxide or by the use of pH buffers, is disclosed in our Swedish patent application SE 9402548-3 and our concurrently filed co-pending U.S. patent application Ser. No. 08/464,564 (Attorney Docket No. 024444-132).

WC, Co and/or Ni are normally the main components in hard materials. However, other metals from groups IVa, Va or VIa of the periodic system of the elements such as Mo, V, Cr, Ta, Ti and Nb are also added particularly in cemented carbide grades for machining of metals. Ti, Ta, and V are according to the method of U.S. Pat. No. 3,440,035 added as carbides to the composite WC-Co powder after the carburization.

OBJECTS AND SUMMARY OF THE INVENTION

It is an object of this invention to avoid or alleviate the problems of the prior art.

It is another object of this invention to provide a method for producing a fine-grained powder of tungsten and cobalt and/or nickel and other metals useful in the production of cemented carbides.

These and other objects are provided by a method for preparing a powder containing tungsten, and cobalt and/or nickel and additional metal comprising mixing ammoniumparatungstate and a basic salt of cobalt and/or nickel in water, reacting the mixture at a temperature from ambient to the boiling point of the solution under agitation, adding a compound of one or more additional metals selected from the group consisting of Mo, V, Cr, Ta, Ti and Nb to the mixture and removing a precipitate of tungsten, cobalt and/or nickel and the additional metal from the solution.

DETAILED DESCRIPTION OF THE PREFERRED EMBODIMENTS OF THE INVENTION

According to the present invention, the elements Mo, V, Cr, Ta, Ti and/or Nb are added in the chemical process step. Ions of the above-mentioned metals precipitate together with the W-Co(Ni) salt, either by chemical substitution of the ions into the structure of the salt, or by precipitation on the surface of the salt.

Ammoniumparatungstate (APT), a white powder with the chemical formula $(NH_4)_{10}H_2W_{12}O_{42}.x.H_2O$ (x=4–11), is suspended in a water solution of a soluble cobalt (II) salt. The grain size of the APT shall be about 0.1–100 μm, preferably 1–10 μm. The initial weight/weight ratio APT/suspension shall be 5–60%, preferably 20–50%, most preferably about 20–30%. The concentration of cobalt in the solution is chosen to give the desired composition of the final material, taking the yield of the chemical reaction into account. The pH is adjusted either, as described in U.S. Pat. No. 3,440,035, by addition of ammonium hydroxide at start or by continuous pH control as disclosed in the above-mentioned Swedish patent application.

The suspension is stirred intensively at temperatures ranging from ambient temperature to the boiling point of the suspension. APT and the dissolved Co-salt react to form a cobalt-tungstate-precipitate. As the reaction proceeds the color of the suspended powder changes from white to pink. The time to complete reaction depends on the temperature, cobalt concentration, grain size, stirring rate and APT/suspension ratio, etc.

The suspension is stirred intensively at temperatures ranging from room temperature to the boiling point of the suspension. APT and $CO(OH)_2$ reacts to form a cobalt-tungstate-precipitate whereby the initially light pink suspension turns more pink. During the reaction, gaseous ammonia is formed and leaves the suspension. The time to complete reaction depends on the temperature, cobalt concentration, grain size, stirring rate and powder/water ratio, etc. The reaction is completed when the color of the suspension has turned from white/pink to pink. A more exact determination of the degree of transformation can be made by conventional powder X-ray diffraction analysis.

The additional metals are added as compounds like oxides, hydroxides, soluble or insoluble salts, etc. The metal ion is, when chemically substituted into the structure, added in the beginning of or during the process, e.g., as $Cr(OH)_3$, $Cr(ClO_4)$, $VCl_3$ or $TiCl_4$. Additions towards the end of the process are more preferable when the elements are precipitated as, e.g., $NH_4VO_3$ on the surface of the grains of the W-Co salt. In the latter case, addition of precipitation agents like ammonium ions may be necessary. The precipitate is filtered off after the reaction is completed, dried and reduced in hydrogen atmosphere to a fine homogeneous metallic powder containing intimately mixed metals.

This mixture may subsequently be carburized either by mixing with carbon and heating or heating the mixture in a carbon-containing gas at a low temperature of about 1000° to 1200° C., preferably from about 1050 to 1150° C., to a metal carbide-Co-powder with a typically submicron grain size where the metal of the metal carbide is W and the additional metal(s). The powder can be mixed with a pressing agent, compacted and sintered to dense cemented carbide. The method according to the presently claimed invention has been described with reference to APT and a cobalt salt but can also be applied to APT, a cobalt salt and/or a nickel salt. The solvent can be water or water mixed with other solvents such as ethanol.

The homogeneous fine composite metal powder can also be used in other applications like materials for catalysis or in materials for alloys of high density.

The invention is additionally illustrated in connection with the following Examples which are to be considered as illustrative of the presently claimed invention. It should be understood, however, that the invention is not limited to the specific details of the Examples.

EXAMPLE 1

580 g cobalt chloride solution (0.293 mole Co/kg solution), 24 g ammonium hydroxide solution (2.5 % $NH_3$) and 200 g APT were charged in a round bottom glass reactor. The suspension was stirred heated up to 87° C. After 5 hours, the suspension was left to cool down to room temperature. 1.52 g ammonium vanadate ($NH_4VO_3$) was added to the suspension to dissolve in the solution. 92 g ammonium acetate ($NH_4Ac$) was added under stirring and ammonium vanadate precipitated on the cobalt-tungstate powder. The Co-W-V salt was filtered and dried at 80° C. overnight.

EXAMPLE 2

141 g cobalt chloride solution (1.71 mole Co/kg solution), 300 g APT, 1.46 g chromium (III) oxide ($Cr_2O_3$) and 900 ml water were charged in a round bottom glass reactor. 36 g concentrated ammonium hydroxide solution (25% $NH_3$) was added under stirring and the color changed from pink to blue. The suspension was heated to 80° C. After 12 hours, the powder was filtered off and dried at 60° C. overnight. The dry weight was 320 g.

EXAMPLE 3

792 g cobalt chloride solution (1.68 mole Co/kg solution), 1600 g APT, 7.0 g $Cr_2O_3$ and 3800 ml water were charged in a round bottom glass reactor. The suspension was heated up to 80° C. The time for warming up to 80° C. was about 50 minutes and the reaction time after that 10 hours. 192 g concentrated (25%) ammonium hydroxide solution was added continuously with a peristaltic pump to maintain the solution pH around 8, starting when the temperature reached 80° C. and ending after 3 hours. The powder was separated by filtration and dried at 80° C. for 1 day.

EXAMPLE 4

300 g cobalt acetate solution (0.27 mole Co/kg solution), and 100 g APT were charged into a round bottom glass reactor. The suspension was stirred and heated until boiling. After boiling for 7 hours, the suspension was left to cool down to room temperature. 0.68 g ammonium vanadate ($NH_4VO_3$) was added to the suspension under stirring to dissolve in the solution. 46 g ammonium acetate ($NH_4Ac$) was added and ammonium vanadate precipitated on the cobalt-tungstate powder. The Co-W-V salt was filtered and dried at 80° C. overnight.

EXAMPLE 5

143 g cobalt chlorine solution (1.71 mole Co/kg solution), 300 g APT, and 1000 ml water were charged in a round bottom glass reactor. 36 g concentrated (25% ) ammonium hydroxide solution was added under stirring, the color changed from pink to blue. The suspension was heated to a temperature of 80° C. A solution of 7.2 g $Cr(ClO_4)_3$ in 200 ml water was added to the suspension after 2 hours. The powder was filtered off after 3 hours at 80° C., and dried at 60° C. overnight. The dry weight was 320 g.

EXAMPLE 6

80 g cobalt chloride solution (1.68 mole Co/kg solution), 150 g APT and 400 ml water was charged in a round bottom glass reactor. The suspension was heated up to 80° C. The time for warming up to 80° C. was about 50 minutes. 192 g concentrated (25%) ammonium hydroxide solution was added continuously with a peristaltic pump to maintain the solution pH around 8, starting when the temperature reached 80° C. and ending after 3 hours. A solution of 1.2 g $VCl_3$ dissolved in 65 ml ethanol was added after 2 hours at 80° C. The powder containing W, Co and V was filtered off after 3 hours and dried at 80° C. for 1 day. The powder was reduced and carburized to a WC-VC-Co-powder.

The principles, preferred embodiments and modes of operation of the presently claimed invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method for preparing a powder containing tungsten, cobalt and/or nickel and additional metal comprising mixing ammoniumparatungstate and a basic salt of cobalt and/or nickel in water to form a reaction mixture, reacting the reaction mixture at a temperature from ambient to the boiling point of the reaction mixture under agitation, adding a compound of one or more additional metals selected from the group consisting of Mo, V, Cr, Ta, Ti and Nb to the reaction mixture, obtaining a co-precipitate of tungsten, cobalt and/or nickel and the additional metal and removing said co-precipitate from the reaction mixture.

2. The method of claim 1 wherein said step of adding a compound of the additional metal to the reaction mixture occurs at the beginning of or during the reaction between W, Co and/or Ni.

3. The method of claim 1 wherein said step of adding a compound of the additional metal to the reaction mixture occurs after a tungsten and cobalt and/or nickel co-precipitate is formed.

4. The method of claim 1 further comprising drying said co-precipitate and heating it in a reducing atmosphere to form a metallic powder.

5. The method of claim 4 further carburizing said metallic powder to form a powder containing WC, cobalt and/or nickel and the additional metal.

* * * * *